US005161845A

United States Patent [19]

Carpenter, Jr.

[11] Patent Number: 5,161,845

[45] Date of Patent: Nov. 10, 1992

[54] LIFTING AND HANDLING DEVICE FOR DRUMS

[75] Inventor: Herbert L. Carpenter, Jr., Cullman, Ala.

[73] Assignee: Greif Bros. Corporation, Delaware, Ohio

[21] Appl. No.: 697,875

[22] Filed: May 9, 1991

[51] Int. Cl.[5] ..... B66C 1/62

[52] U.S. Cl. ..... 294/90; 294/81.61; 294/104

[58] Field of Search ..... 294/4, 31.1, 81.61, 294/86.12, 90, 93-97, 101, 104, 106, 113, 119.2; 414/450, 452, 607, 608, 621, 626

[56] References Cited

U.S. PATENT DOCUMENTS

| | | | |
|---|---|---|---|
| 2,327,005 | 8/1943 | Babcock et al. | 294/106 |
| 2,500,055 | 3/1950 | Baker | 294/31.1 X |
| 2,628,120 | 2/1953 | Triestram | 294/31.1 |
| 3,190,685 | 6/1965 | Bopp | 294/90 |
| 3,253,850 | 5/1966 | Trusty | 294/31.1 X |
| 3,257,143 | 6/1966 | Wansley | 294/101 |
| 3,264,027 | 8/1966 | Luther | 294/90 X |
| 3,278,218 | 10/1966 | Lebre | 294/90 X |
| 3,352,591 | 11/1967 | Casey | 294/90 X |

FOREIGN PATENT DOCUMENTS

| | | | |
|---|---|---|---|
| 2576007 | 7/1986 | France | 294/90 |
| 131550 | 7/1978 | German Democratic Rep. | 294/90 |
| 8403445 | 6/1986 | Netherlands | 294/90 |
| 514767 | 9/1976 | U.S.S.R. | 294/90 |
| 1085925 | 4/1984 | U.S.S.R. | 294/90 |

*Primary Examiner*—Johnny D. Cherry

*Attorney, Agent, or Firm*—Kane, Dalsimer, Sullivan, Kurucz, Levy, Eisele and Richard

[57] ABSTRACT

A device for lifting and handling open end drums, especially fiber, or other non-metallic drums includes a support, an inner member and toggle clamps mounted on the support. The toggle clamps cooperate with the inner member to engage the open top of the drum. The drum can then be lifted by engaging and lifting the support.

13 Claims, 6 Drawing Sheets

LIFTING AND HANDLING DEVICE FOR DRUMS

BACKGROUND OF THE INVENTION a. Field of Invention

This invention pertains to a device for handling open-topped drums, and more particularly to a device adapted to engage the top of the drum so that a filled drum can be lifted and repositioned on a truck bed, pallet, etc.

b. Description of the Prior Art

Non-metallic open top drums, such as drums made of fiber, or a plastic material are presently preferred for shipping various materials for a variety of reasons. However these drums, which may weigh up to 600 pounds or more, when filled are difficult to handle. If an operator tries to tip such a drum so that it can be rolled, the operator may suffer injury. In addition, if the drum is dropped on its side too suddenly, it may break open and spill its contents. Typically, these types of drums are provided at the top and the bottom with a metal chime having a peripheral groove or bead which secures the chime to the drum. The chime is used to secure the drum bottom and top to the drum body. Once a drum is closed, the chime may also be used to handle the drum. More particularly, trucks, or fork lifts may be equipped with parrot-beak devices which grasp the chime and allow an operator to lift and handle the drum. However, these parrot-beak devices are expensive.

Moreover, recently there has been a demand for drums that can be compacted and recycled. However recycling stations will not accept compacted drums with metal parts. Thus, non-metallic drums are preferable from an environmental viewpoint. However, until now filled non-metallic drums were difficult to handle, as discussed above.

OBJECTIVES AND SUMMARY OF THE INVENTION

In view of the above-mentioned disadvantages of the prior art, it is an objective of the present invention to provide a device for easy handling of filled drums.

A further objective is to provide a device strong enough to lift fully loaded drums.

Yet another objective is to provide a device which is simple to use so that it requires no special training, and is inexpensive.

Other objectives and advantages of the invention shall become apparent from the following description of the invention. Briefly, the invention includes a device for lifting drums having a drum top comprising support means, an inner member mounted on said support means and constructed into said drum top means, and clamping means mounted on said support means and having a disengaged position and an engaged position. The clamping means cooperating with the inner member to clamp to the top of the drum top therebetween whereby the drum is lifted by engaging and lifting the support means. The said support means include attachment means for attaching said support means to a lifting device.

The clamp means may include a clamping surface selectively pivoted between a first position in which said clamping means is disengaged, and a second position in which said clamping surface is disposed in a facing relation with said inner member.

DETAILED DESCRIPTION OF THE INVENTION

Figure 1:
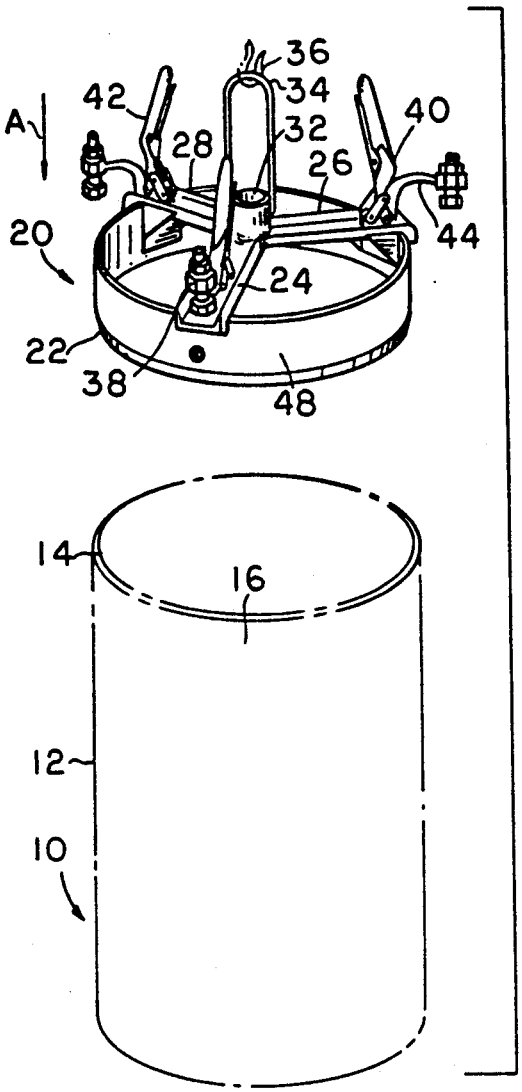
FIG. 1 shows an elevational perspective view of a device in accordance with this invention positioned to engage an open top drum.

FIG. 1 shows a typical fiber drum 10 having a cylindrical body 12 with an open top defined by rim 14, which in this embodiment is circular. Once this drum 10 is filled, it may be lifted by a handling device 20. Device 20 includes a ring 22 made, for example, of steel and having a shape matching the shape of the open top on the drum. Moreover, the ring is sized so that it is slightly smaller than the drum top so that it can fit easily into the drum. The device is also provided with three channels 24, 26, 28 attached to the ring, and joined to a cylindrical hub 32. Preferably the channels are welded to the ring 22 to provide a strong bracing. A lifting hoop 34 is welded to the hub 32 oriented upwardly as shown. When the device 20 is in operation a hook 36 attached to an overhead crane, a truck mounted crane or other similar power lifting apparatus may be used to lift or lower device 20 by engaging hoop 34 as shown.

Figure 2:
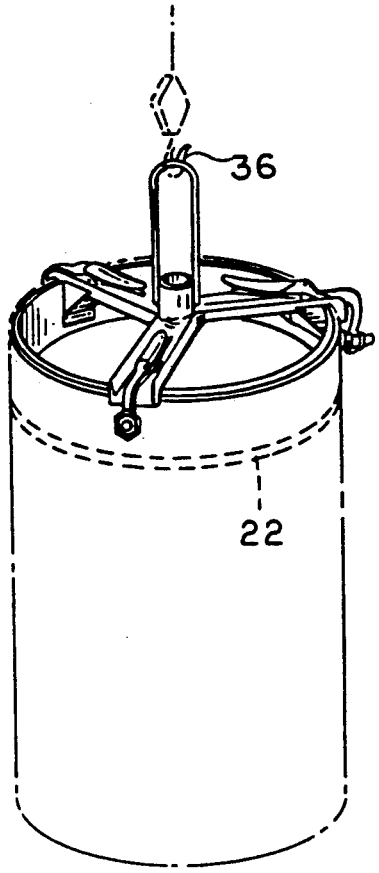
FIG. 2 shows a perspective view of the device of FIG. 1 after it has engaged the drum.

Mounted on each arm 24, 26, 28, adjacent to ring 22 is a drum engaging mechanism which preferably is in the form of strong toggle clamps 38, 40, 42 respectively. The operation of these clamps is explained in detail below. Each clamp includes an arm 44 terminating in a clamping surface 46. When the device 20 is lowered into the drum 10, as indicated by arrow A in FIG. 1, the arms are pivoted upwardly to a disengaged position so that they do not interfere with the drum. Once the ring 2 is seated inside the drum with the channels extending radially outwardly of rim 14, each of the toggle clamps are locked manually to an engaged configuration. As shown in FIG. 2, in this configuration the arm 44 is in an engaged position, pointing downward, so that clamping surface 46 comes into contact with the outer wall 16 of the drum 10. The clamps use springs or other biasing means which in the locked position urge the clamping surface 46 inward in the radial direction. Thus, clamping surface 46 and the outer cylindrical surface 48 of ring 22 cooperate to engage and lock onto the drum 10.

Once device 20 is engaged to the drum 10 as discussed above, the device 20 and the drum are lifted together via hook 36 to position the drum as required, for example on a truck bed. Thereafter, the device 20 is disengaged from the drum 10 (as discussed below) and the drum is closed and sealed, for example by using a slip-over cover which fits over rim 14 and taping the cover to drum sidewall 16. The drum is now ready for shipping.

Figure 5:
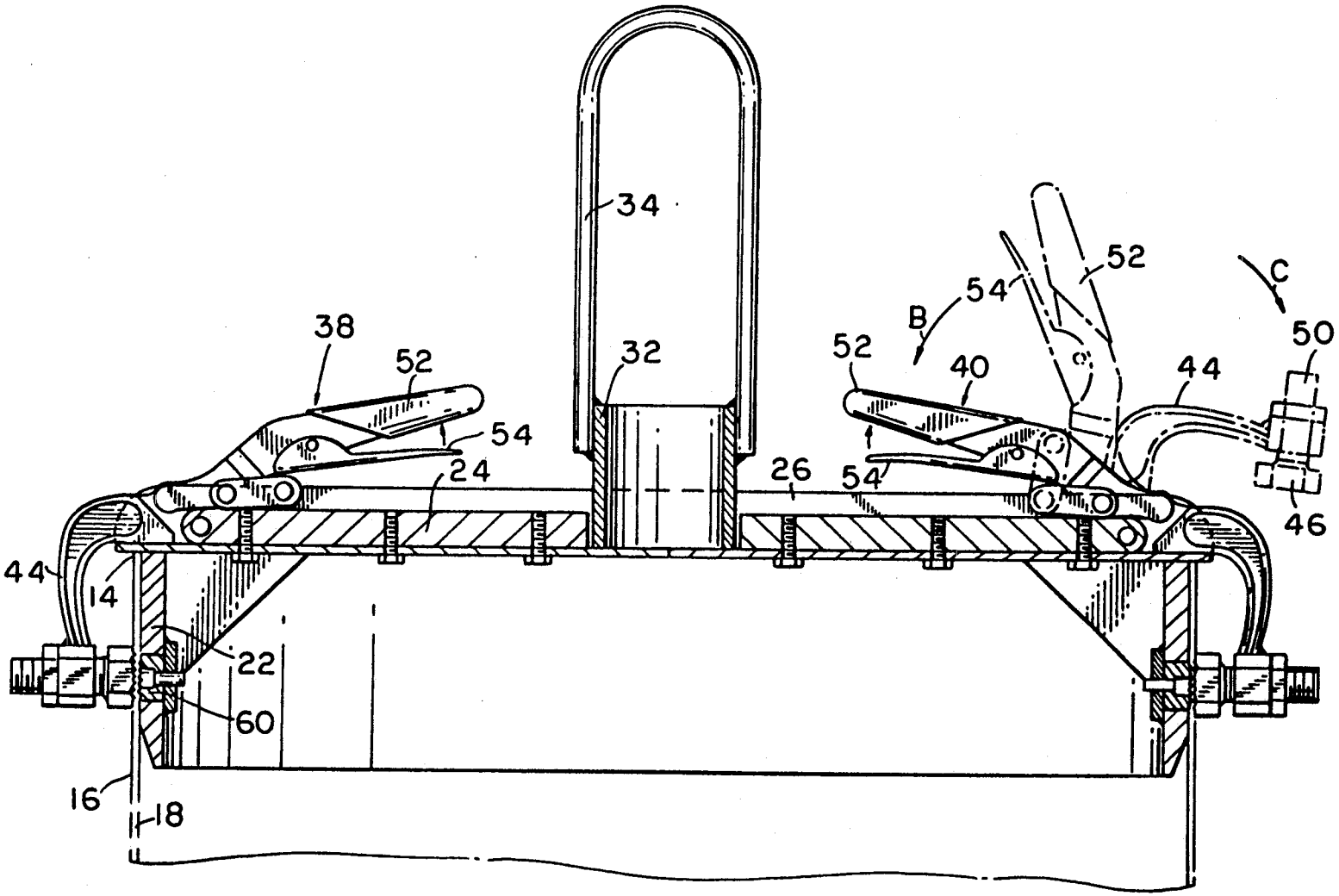
FIG. 5 shows a side-sectional view of the device of FIGS. 1–4 with both clamps in the closed position.
Figure 6:
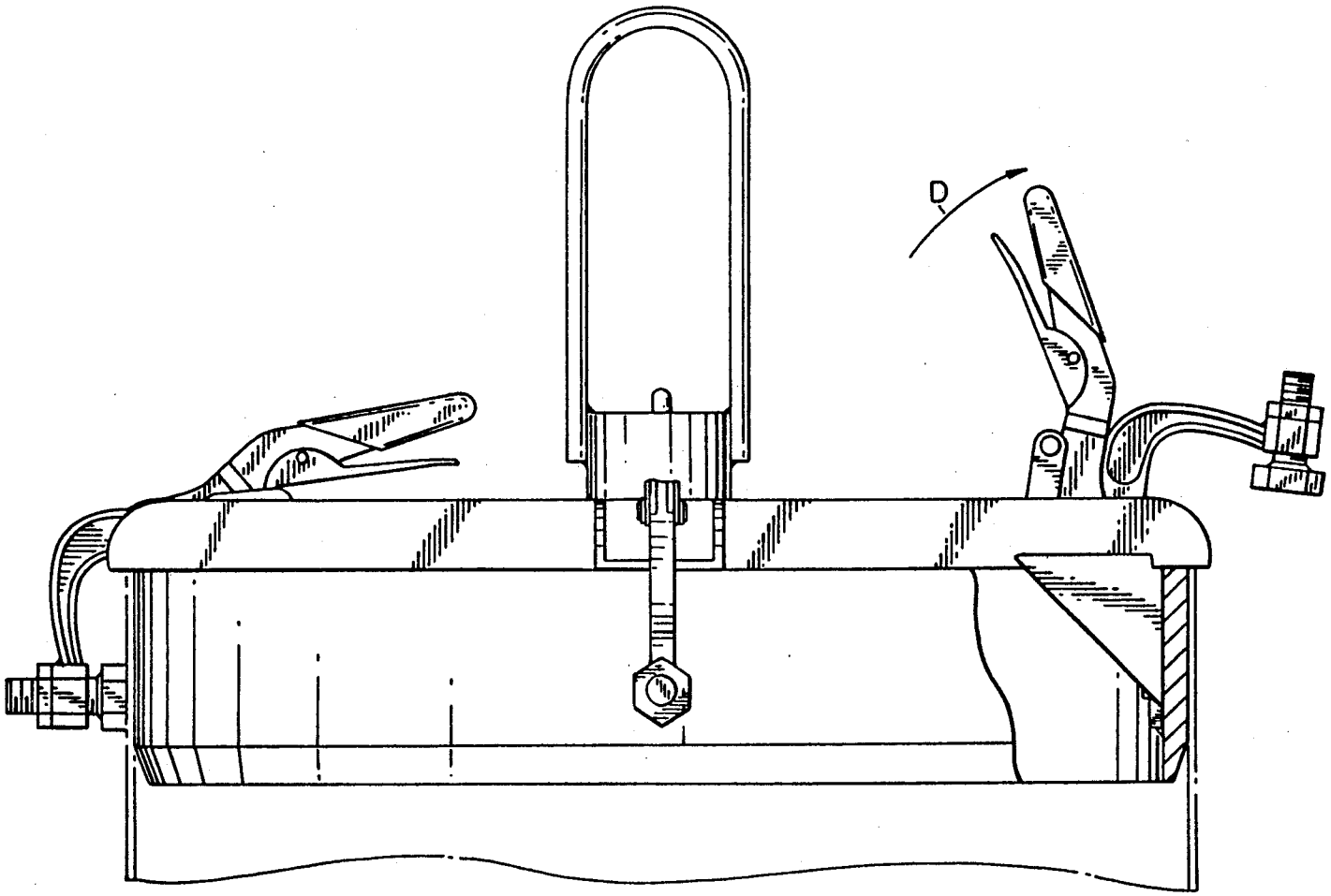
FIG. 6 shows a side-sectional view of the device of FIG. 5 with one clamp in the open position, and another clamp in the closed position.

Referring now to FIG. 5, each toggle clamp consists of an arm 44 holding a screw 50 terminating in a clamping surface 46. Arm 44 is controlled by a handle 52. When the clamp is disengaged as shown in phantom lines on the right side of FIG. 5, both arm 44 and handle 52 are up. When handle 52 is manually pivoted counterclockwise, as shown by arrow B, arm 44 is pivoted clockwise (as indicated by arrow C). When handle 52 reaches its locked position as shown on the left side of FIG. 5 for clamp 38, clamping surface 46 contacts outer sidewall 16. At the same time outer surface 48 of ring 22 is in contact with the inner surface 18 of drum 10 thereby locking onto and engaging the drum. Once handle 52 reaches the locked position, it remains in that position until a release mechanism is activated. Thus the operator locks each toggle clamp sequentially and then lifts the drum to any desired position. Once the drum is positioned, the device is disengaged by releasing each toggle clamp individually. For this purpose, each toggle clamp is provided with a release member 54. When this release member is pulled or pivoted upwards, it causes the handle 52 to move upward back to the released position, as indicated in FIG. 6 by arrow D. Thus each clamp is released to the disengaged position. Toggle clamps of this type are wellknown in the art and need not be described any further.

Figure 7:
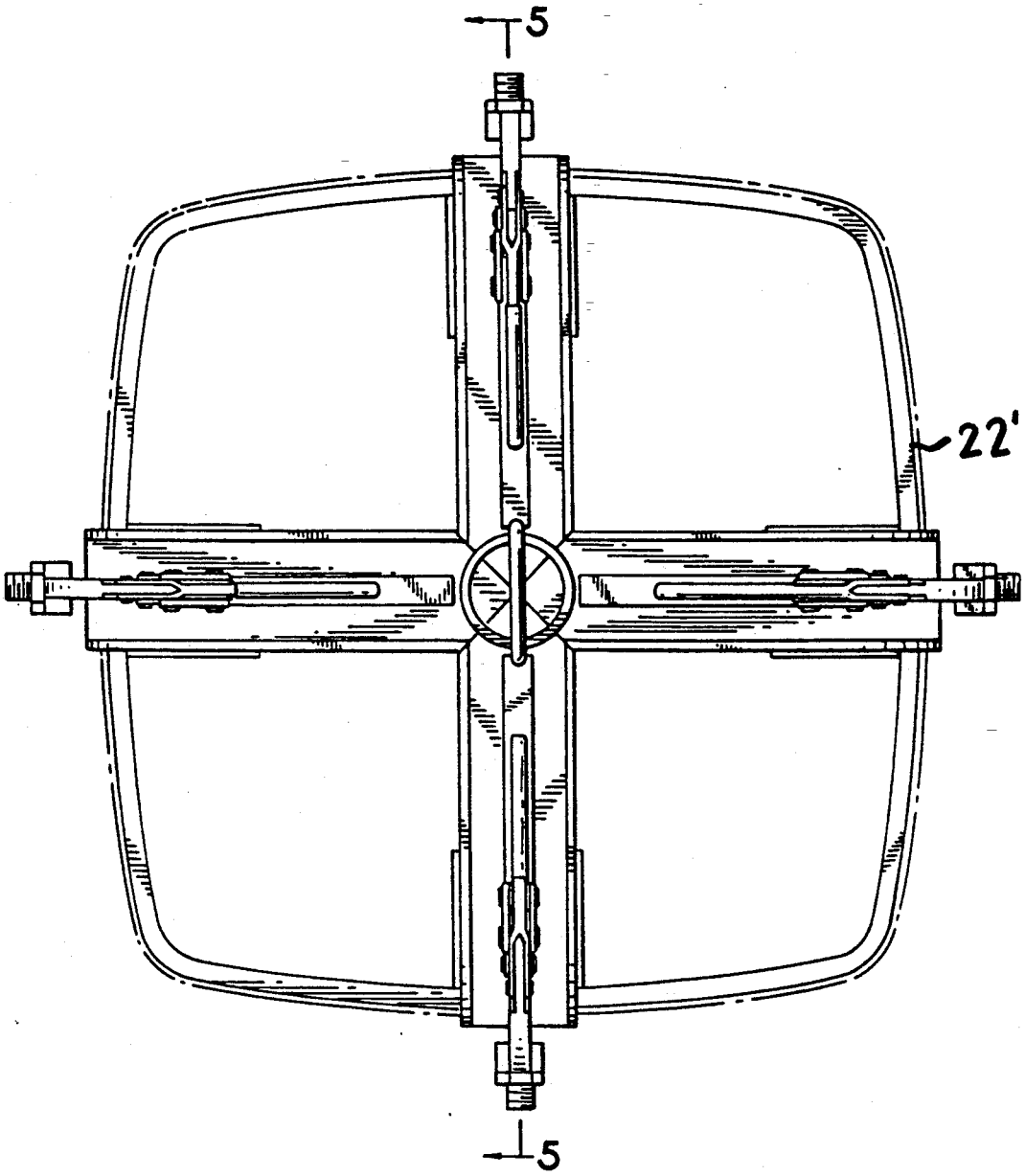
FIG. 7 shows a top view of an alternate embodiment of the invention.

As can be seen from the above description, it is important that the ring 22 be disposed adjacent to the inner wall 18 of the drum at least in the vicinity of the toggle clamps. Therefore, for a circular drum, ring 22 is preferably also circular. For drums having a different shape such as a rounded square shown in FIG. 7, a corresponding member 22' can be provided to match the cross-section of the drum. For this shape, four channels may be provided, each supporting a corresponding toggle clamp, as shown.

Figure 8:
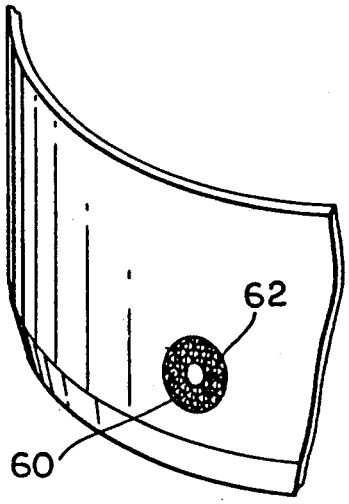
FIG. 8 shows exploded detail of a ring used in the devices of FIGS. 1–7.
Figure 3:
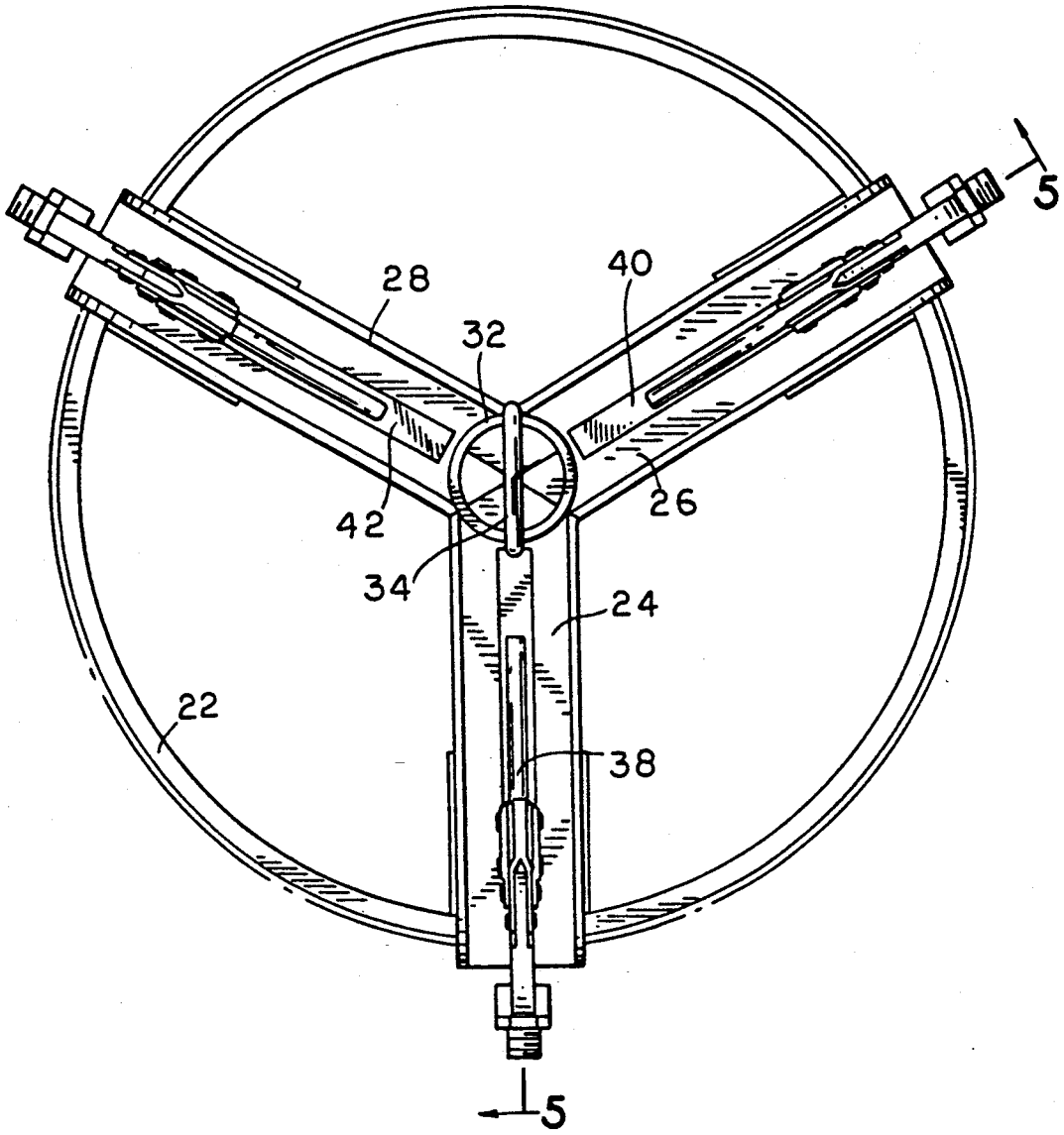
FIG. 3 shows a top view of the device of FIGS. 1 and 2.
Figure 4:
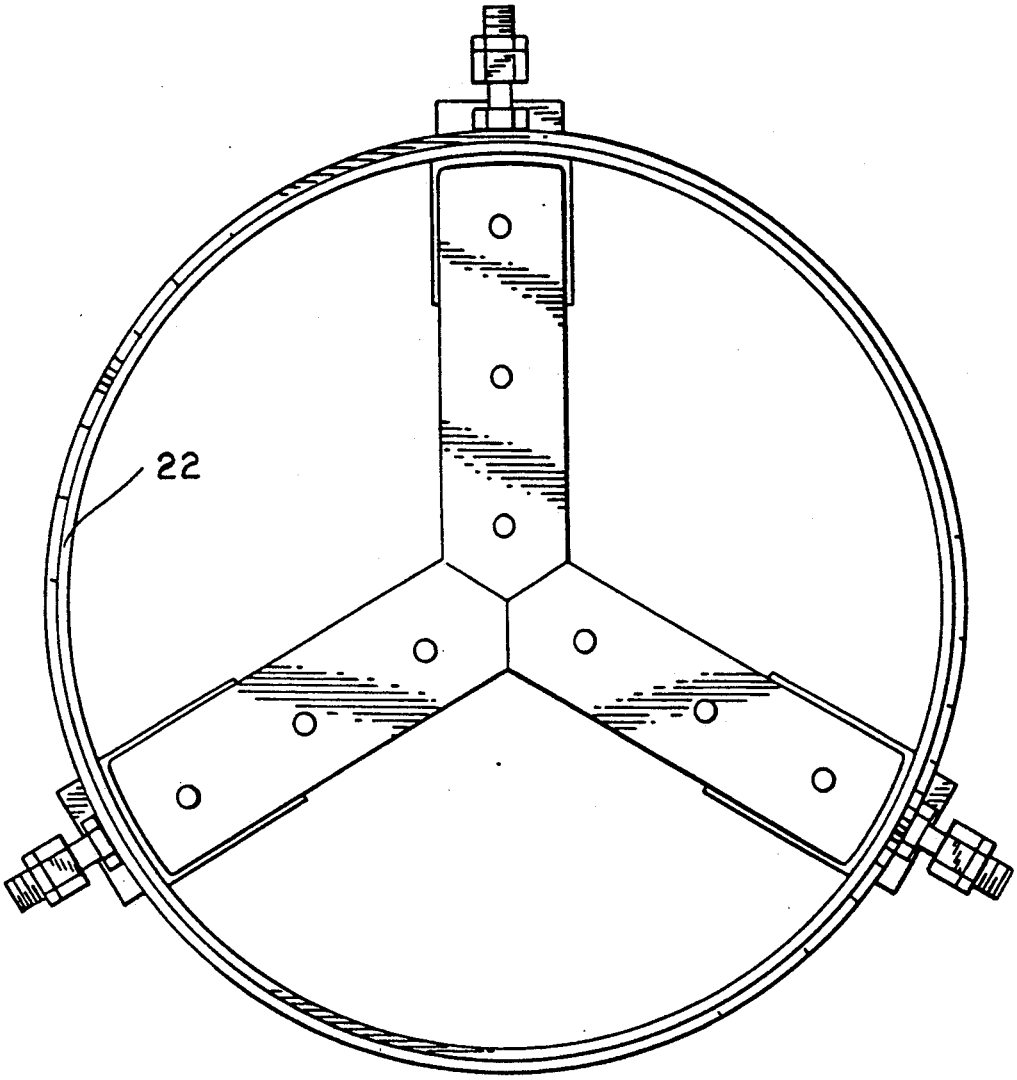
FIG. 4 shows a bottom view of the device.

As described above, the device 20 engages the drum 10 through a clamping action that takes place between clamping surface 46 and outer surface 48 of ring 22. In order to insure that this clamping action is strong enough to support the drum, and that the drum does not slip out, ring 22 may be provided with inserts 60 shown in detail in FIG. 8. These inserts are preferably made of hardened tool grade steel and are provided with a sharp, multiple edged surface 62. Inserts 60 are positioned so that when the toggle clamps are locked, their clamping surface 46 faces a corresponding insert 60, as shown in FIG. 5.

Thus, it is clear that a device as described herein may be used to safely and efficiently lift loaded drums. In fact, it was found that this simple mechanism may be used to lift fiber drums weighing 400 pounds. Importantly, when the device was disengaged, the drum showed virtually no markings along its rim indicating that it was not damaged.

Obviously numerous modifications can be made to this invention without departing from its scope as defined in the appended claims.

I claim:

1. A device for engaging a drum having a cylindrical rim defined by a drum inner surface and a drum outer surface, said drum surfaces extending in parallel, said device comprising:

a support;

an attachment mounted on said support for attachment to a lifting device;

a ring attached to said support, said ring having a ring outer surface conforming in size and shape to said drum inner surface wherein said ring outer surface is disposed adjacent to said drum inner surface when said support is positioned on said rim; and a plurality of clamps mounted on said support and disposed peripherally about said ring, each clamp having a clamping surface pivotable between a first and second position, said clamping surface in said second position contacting said drum outer surface and cooperating with said ring outer surface to engage said rim therebetween, each of said clamps further comprising independent locking means for locking said clamping surface in said second position independently of the other clamps.

2. The device of claim 1 wherein said ring is round.

3. The device of claim 1 wherein said ring shape is a rounded square.

4. The device of claim 1 wherein each said clamp comprises a toggle clamp.

5. The device of claim 1 wherein said ring includes inserts disposed on said outer surface opposite said ring outer surface.

6. The device of claim 5 wherein said inserts have a rough surface.

7. A device for engaging a drum having an open top defined by a cylindrical drum rim, said device comprising:

a support having a hub and a plurality of channels, each channel having one end attached to said hub and a second end disposed radially away from said hub;

an attachment hoop secured to said hub;

a ring mounted circumferentially on said second ends and having an outer continuous ring surface, said ring being constructed and arranged to fit snugly inside said open top when said support is disposed on said rim; and a plurality of toggle clamps mounted on said support, said toggle clamps each having a pivoting clamp surface and an individual handle for selectively and independently clamping a portion of said rim between said ring surface and said clamp surface whereby each clamp can be operated independently of the other clamps;

whereby said drum can be lifted by said attachment hoop when said rim is clamped between said toggle clamps and said outer ring surface.

8. The device of claim 7 wherein said outer surface includes a plurality of inserts disposed in a facing relation with said toggle clamps.

9. The device of claim 8 wherein said inserts and said clamp surfaces are made of hardened steel.

10. The device of claim 7 wherein said toggle clamps each have a locking handle to lock said clamps to said ring.

11. The device of claim 10 wherein said toggle clamps each have a release handle for releasing said clamps from said ring.

12. The device of claim 7 wherein said ring is round.

13. The device of claim 7 wherein said ring is a rounded square.

* * * * *